US010580390B2

(12) United States Patent
Akaishi et al.

(10) Patent No.: US 10,580,390 B2
(45) Date of Patent: Mar. 3, 2020

(54) KEYBOARD INSTRUMENT

(71) Applicant: CASIO COMPUTER CO., LTD., Shibuya-ku, Tokyo (JP)

(72) Inventors: Akihito Akaishi, Hino (JP); Hirokazu Taniguchi, Tachikawa (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 0 days.

(21) Appl. No.: 16/532,325

(22) Filed: Aug. 5, 2019

(65) Prior Publication Data

US 2020/0043446 A1 Feb. 6, 2020

(30) Foreign Application Priority Data

Aug. 6, 2018 (JP) ..... 2018-147910

(51) Int. Cl.
*G10C 3/18* (2006.01)
*G10C 3/23* (2019.01)

(52) U.S. Cl.
CPC ..... *G10C 3/18* (2013.01); *G10C 3/23* (2019.01)

(58) Field of Classification Search
CPC ..... G10C 3/18; G10C 3/23
See application file for complete search history.

(56) References Cited

U.S. PATENT DOCUMENTS

2013/0074683 A1* 3/2013 Ishida ..... G10H 1/346 84/744

FOREIGN PATENT DOCUMENTS

| | | | |
|---|---|---|---|
| JP | H05113787 | A | 5/1993 |
| JP | H0734480 | U | 6/1995 |
| JP | 2000122655 | A | 4/2000 |
| JP | 2012173556 | A | 9/2012 |

* cited by examiner

*Primary Examiner* — Kimberly R Lockett
(74) *Attorney, Agent, or Firm* — Holtz, Holtz & Volek PC

(57) ABSTRACT

A keyboard instrument including a hammer unit which includes a plurality of hammer members each of which has an effort point provided on one end side, a load point provided on an other end side, and a fulcrum provided between the effort point and the load point, and a hammer holder which rotatably holds the plurality of hammer members, and a keyboard chassis which includes a restriction member for restricting rotations of the plurality of hammer members performed in response to key depression operations within a restriction range and in which the hammer unit is mounted, in which the hammer holder has a plurality of contact points on the effort point side which comes in contact with portions of the plurality of hammer members on the effort point side when the hammer unit is in a vertically inverted state.

8 Claims, 13 Drawing Sheets

KEYBOARD INSTRUMENT

CROSS-REFERENCE TO RELATED APPLICATION

This application is based upon and claims the benefit of priority from the prior Japanese Patent Application No. 2018-147910, filed Aug. 6, 2018, the entire contents of which are incorporated herein by reference.

BACKGROUND OF THE INVENTION

1. Field of the Invention

The present invention relates to a keyboard instrument such as an electronic piano.

2. Description of the Related Art

For example, a keyboard instrument is known which has a structure where a plurality of keys has been mounted on a keyboard chassis in a manner to be vertically rotatable, and a plurality of hammer members for applying action loads to the plurality of keys has been mounted on the undersurface of the keyboard chassis by hammer holders, as disclosed in Japanese Utility-Model Application Laid-Open (Kokai) Publication No. 07-034480.

In the assembly of this keyboard instrument having the structure where the plurality of hammer members is mounted on the undersurface of the keyboard chassis by the hammer holders, the plurality of hammer members is rotatably attached to the hammer holders by use of their shaft sections, whereby a hammer unit is assembled. Then, this hammer unit is mounted on the keyboard chassis. However, when the hammer unit is to be mounted, the plurality of hammer members individually rotates centering on their shaft sections and the weight section side of each hammer member hangs down significantly, which impairs the assembling work efficiency.

An object of the present invention is to provide a keyboard instrument capable of improving assembling work efficiency.

SUMMARY OF THE INVENTION

In accordance with one aspect of the present invention, there is provided a keyboard instrument comprising: a hammer unit which includes (i) a plurality of hammer members each of which has an effort point provided on one end side, a load point provided on an other end side, and a fulcrum provided between the effort point and the load point, and (ii) a hammer holder which rotatably holds the plurality of hammer members; and a keyboard chassis which includes a restriction member for restricting rotations of the plurality of hammer members performed in response to key depression operations within a restriction range, and in which the hammer unit is mounted, wherein the hammer holder has a plurality of contact points on the effort point side which comes in contact with portions of the plurality of hammer members on the effort point side when the hammer unit is in a vertically inverted state, in order to achieve a structure where a first length between the fulcrum of each of the plurality of hammer members and the other end of each of the plurality of hammer members in a front-rear direction of keys is longer than a second length between the fulcrum and one end of the restriction member on the fulcrum side in the front-rear direction of the keys when the hammer unit is in the vertically inverted state so as to be mounted on the keyboard chassis in a vertically inverted state.

According to the present invention, assembling work efficiency is improved.

The above and further objects and novel features of the present invention will more fully appear from the following detailed description when the same is read in conjunction with the accompanying drawings. It is to be expressly understood, however, that the drawings are for the purpose of illustration only and are not intended as a definition of the limits of the invention.

BRIEF DESCRIPTION OF THE DRAWINGS

FIG. 4A to FIG. 4C are diagrams showing a hammer member for a white key on the hammer unit shown in FIG. 3, of which FIG. 4A is a perspective view of the hammer member, FIG. 4B is a perspective view of its hammer body, and FIG. 4C is a perspective view of its shaft section;

FIG. 5A to FIG. 5C are diagrams showing a hammer member for a black key on the hammer unit shown in FIG. 3, of which FIG. 5A is a perspective view of the hammer member, FIG. 5B is a perspective view of its hammer body, and FIG. 5C is a perspective view of its shaft section;

FIG. 7A and FIG. 7B are cross-sectional views of the hammer holder shown in FIG. 6, of which FIG. 7A is an enlarged sectional view showing the main portion of the hammer holder taken along line A-A in FIG. 6, and FIG. 7B is an enlarged sectional view showing the main portion of the hammer holder taken along line B-B in FIG. 6;

FIG. 13A and FIG. 13B are diagrams showing a structure for positioning the hammer holder with respect to the keyboard chassis shown in FIG. 12, of which FIG. 13A is a rear side view of the main portion of the keyboard chassis and FIG. 13B is a rear side view of the hammer holder.

DETAILED DESCRIPTION OF THE PREFERRED EMBODIMENTS

An embodiment of a keyboard instrument where the present invention has been applied will hereinafter be described with reference to FIG. 1 to FIG. 13B.

Figure 1:
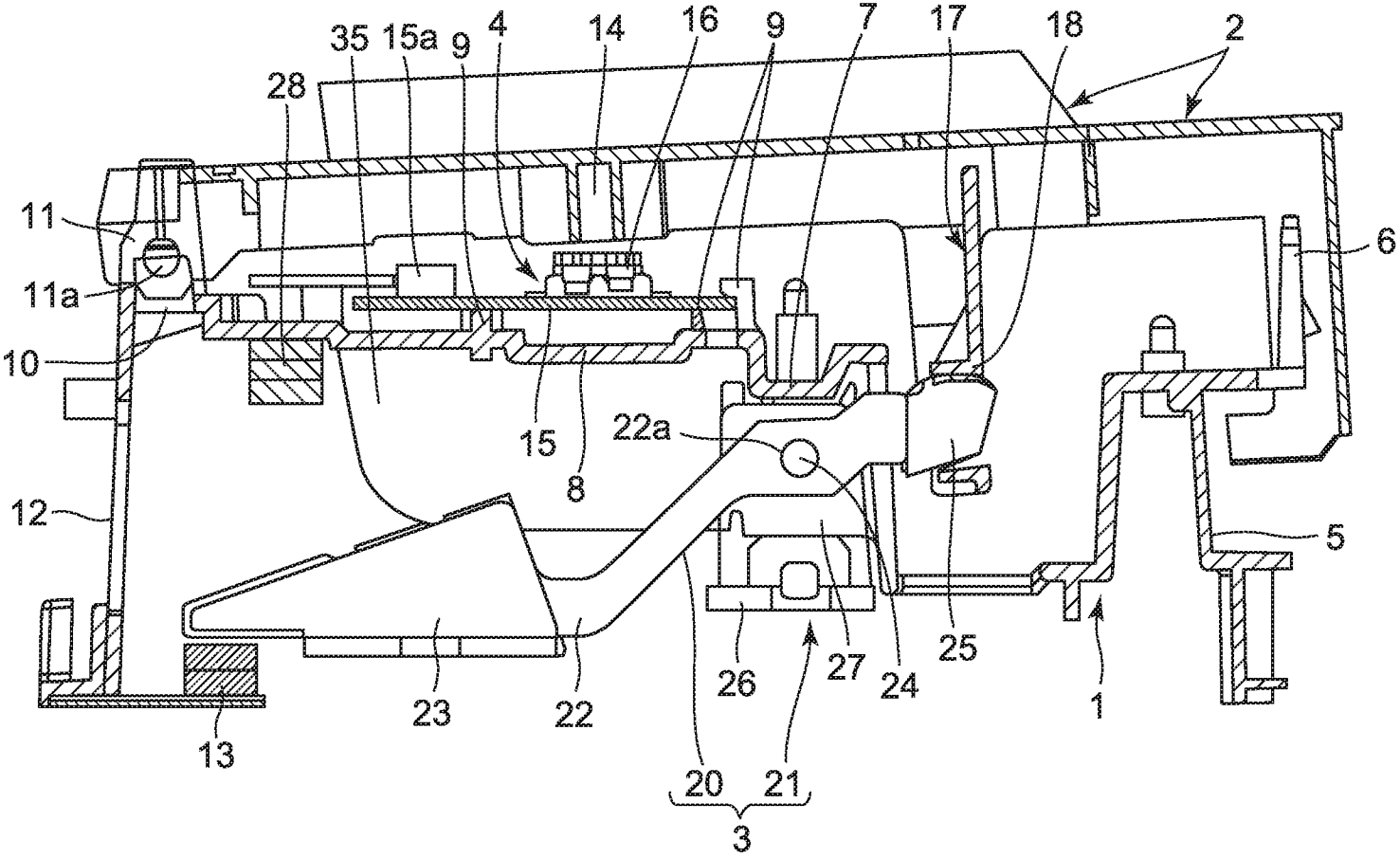
FIG. 1 is a cross-sectional view showing an embodiment of a keyboard instrument where the present invention has been applied.
Figure 2:
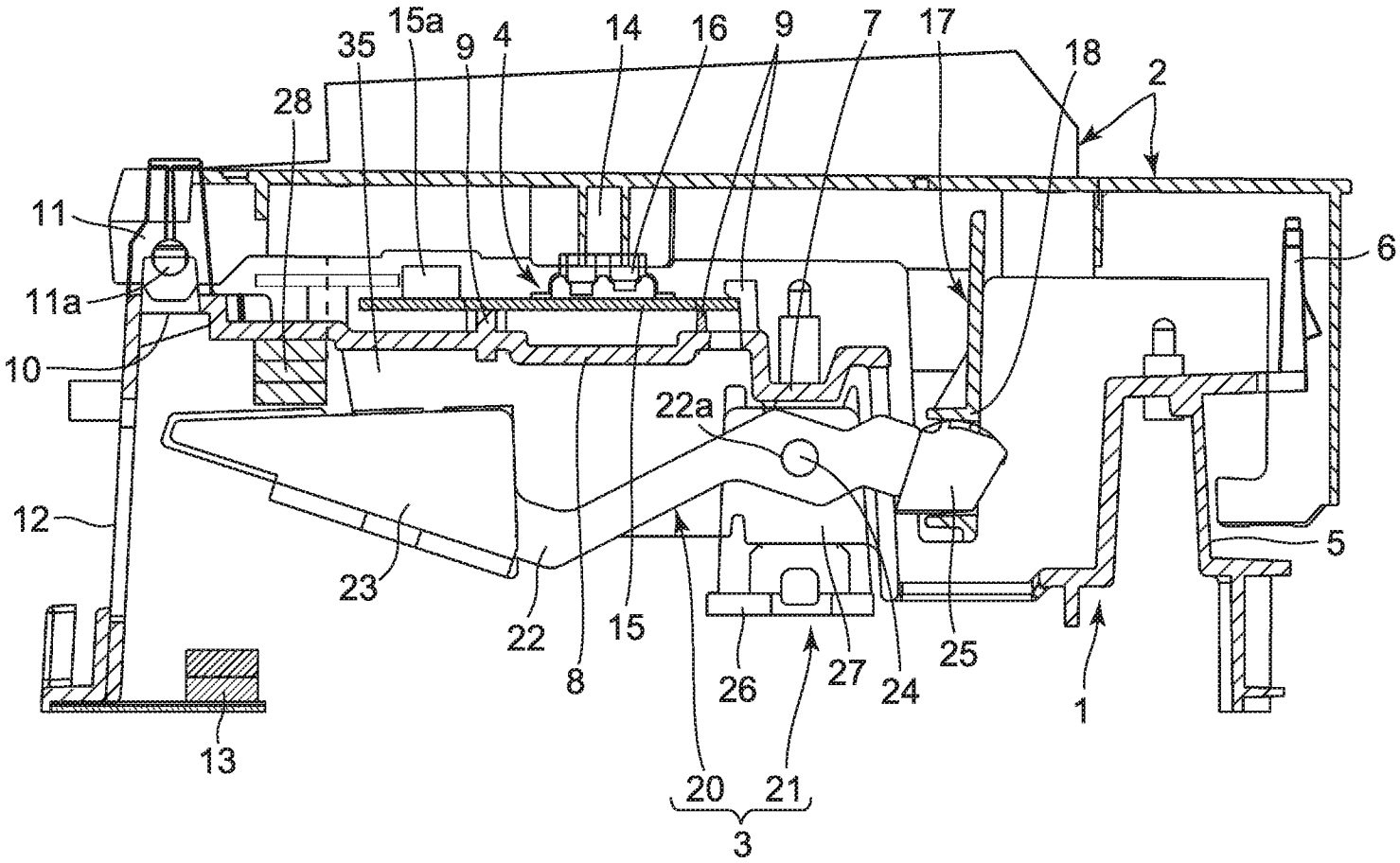
FIG. 2 is a cross-sectional view showing a state where a white key of the keyboard instrument shown in FIG. 1 has been depressed.

This keyboard instrument is constituted by a keyboard chassis 1 made of synthetic resin such as ABS resin, a plurality of keys 2 which is arranged and mounted on the keyboard chassis 1 in a manner to be rotatable in the vertical direction, a plurality of hammer units 3 for applying action loads to the plurality of keys 2 in response to key depression operations performed on the plurality of keys 2, and a plurality of switch sections 3 which is turned on in response to key depression operations performed on the plurality of keys 2, as shown in FIG. 1 and FIG. 2.

The keyboard chassis 1 is a member arranged in a musical instrument case (not shown). On the front end (right end in FIG. 1) of this keyboard chassis 1, a front leg section 5 is provided projecting upward from the bottom of the keyboard chassis 1, as shown in FIG. 1 and FIG. 2. On the upper part of the front leg section 5, a plurality of key guiding sections 6 for preventing the horizontal displacement of each key 2 is provided corresponding to these keys 2. In an area behind (left side in FIG. 1) the front leg section 5 on the keyboard chassis 1, a unit mounting section 7 is provided projecting at substantially the same height as that of the front leg section 5.

In a substantially middle area of the keyboard chassis 1 in the front-rear direction (horizontal direction in FIG. 1), that is, in an area behind and above the unit mounting section 7, a board mounting section 8 is provided projecting at a position one step higher than the unit mounting section 7, as shown in FIG. 1 and FIG. 2. On this board mounting section 8, the switch sections 4 are supported by a plurality of board supporting sections 9. These board supporting sections 9 are provided upright on front and rear portions of the upper surface of the board mounting section 8.

Also, on the rear part of the keyboard chassis 1, that is, on the rear side of the board mounting section 8, a key mounting section 10 is provided projecting slightly lower than the upper parts of the key guiding sections 6, as shown in FIG. 1 and FIG. 2. On the upper surface of this key mounting section 10, a plurality of key supporting sections 11 projecting upward is provided at even intervals along the array direction of the keys 2. These key supporting sections 11 are provided with key supporting shafts 11*a* which support the rear ends of the keys 2 such that the keys 2 are rotatable in the vertical direction.

Moreover, on the rear end of the keyboard chassis 1, a rear leg section 12 for supporting the rear end of the keyboard chassis 1 is provided to downwardly extend from the upper part of the keyboard chassis 1 toward the bottom part, as shown in FIG. 1 and FIG. 2. In an area near the lower end of this rear leg section 12, a lower-limit stopper 13 such as felt for restricting the lower-limit positions of the later-described hammer members 20 on each hammer unit 3 is provided.

The plurality of keys 2 includes white keys and black keys, as shown in FIG. 1 to FIG. 2. However, here, only one white key is described as an example. The rear end (left end in FIG. 1) of this key 2 is supported by the key supporting shaft 11*a* of the corresponding key supporting section 11 on the key mounting section 10 of the keyboard chassis 1 in a manner to be rotatable in the vertical direction. On a substantially middle portion of the key 2 in the front-rear direction (the left-right direction in FIG. 1), a switch pressing section 14 for pressing one of the switch sections 4 mounted on the board mounting section 9 of the keyboard chassis 1 is provided projecting downward.

Each switch section 4 has a dome-shaped bulging section 16 formed by a rubber sheet arranged on a switch board 15 being partially bulged, as shown in FIG. 1 and FIG. 2. That is, a plurality of dome-shaped bulging sections 16 are provided on the switchboard 15 while corresponding to the switch pressing sections 14 of the keys 2. The switch board 15 is mounted on the keyboard chassis 1 such that it is positioned above the board mounting section 8 and its front end (right end in FIG. 1) and the other end (left end in FIG. 1) are arranged on the board supporting sections 9 provided on the board mounting section 8.

Also, each switch section 4 is structured such that, when its bulging section 16 on the rubber sheet is pressed by the corresponding switch pressing section 14, this bulging section 16 is elastically deformed, and a moving contact therein comes in contact with a fixed contact on the switch board 15, so that an ON signal is outputted, as shown in FIG. 1 and FIG. 2. On the switch board 15, a sound emission section 15*a* is provided which generates musical sound information based on an ON signal outputted from one of the switch sections 4 and emits a musical sound from a speaker (not shown in the drawing) based on the generated musical sound information.

On a portion of each key 2 located in front (to the right in FIG. 1) of its switch pressing section 14, a hammer pressing section 17 is provided projecting downward therefrom, as shown in FIG. 1 and FIG. 2. On a lower portion of this hammer pressing section 17, a hammer connecting section 18 is provided, on which a key connecting section 25 that is the effort point of the later-described hammer member 20 constituting a hammer unit 3 is arranged.

Figure 3:
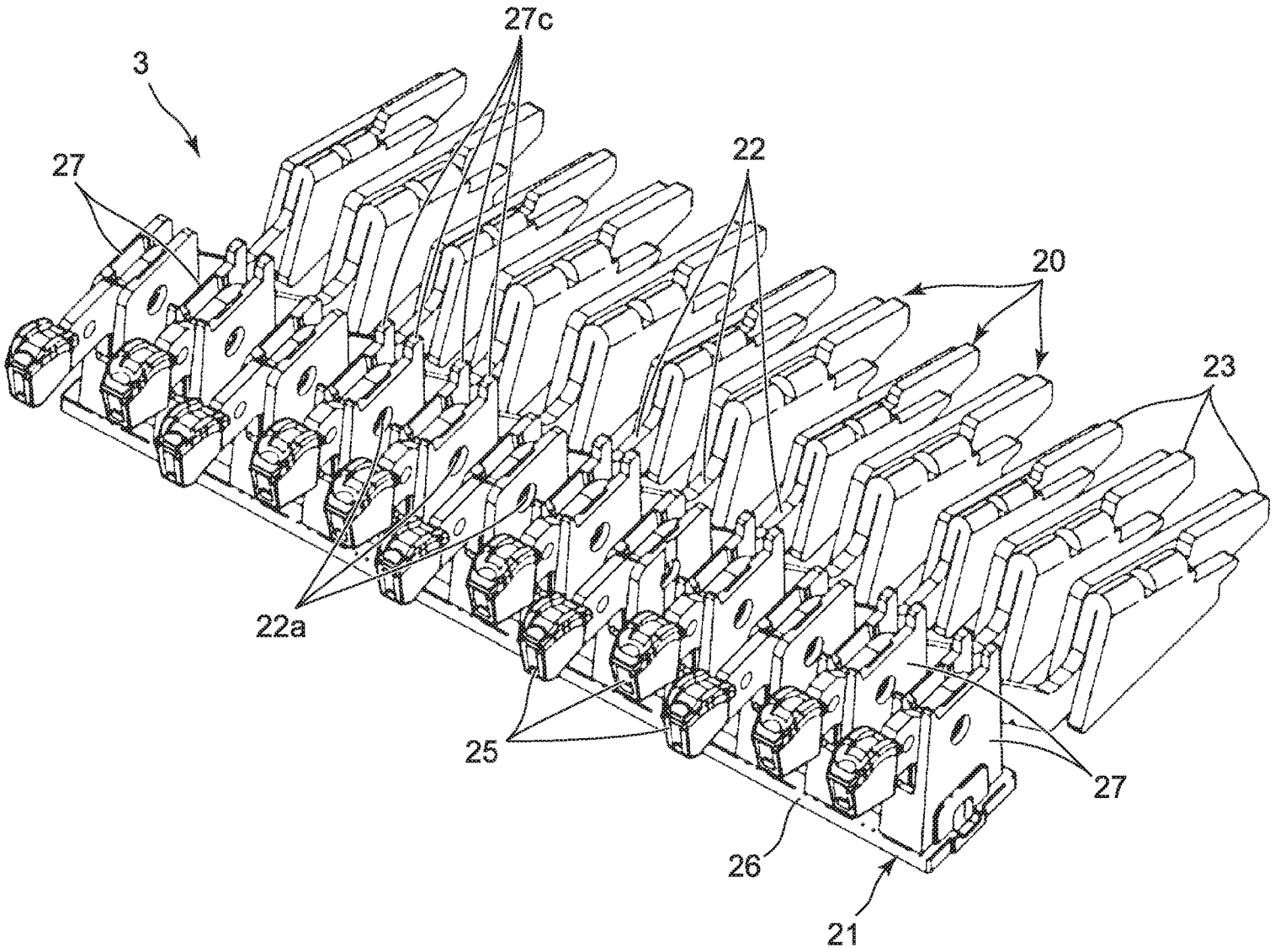
FIG. 3 is an enlarged perspective view showing the main portion of a hammer unit of the keyboard instrument shown in FIG. 1.

Each hammer unit 3 includes a plurality of hammer members 20 which is rotated in response to key depression operations performed on keys 2 and applies action loads to these keys 2, and a hammer holder 21 which is attached to the undersurface of the unit mounting section 7 of the keyboard chassis 1 where the plurality of keys 2 are arrayed and rotatably holds the plurality of hammer members 20, as shown in FIG. 1 to FIG. 3.

Figure 4A:
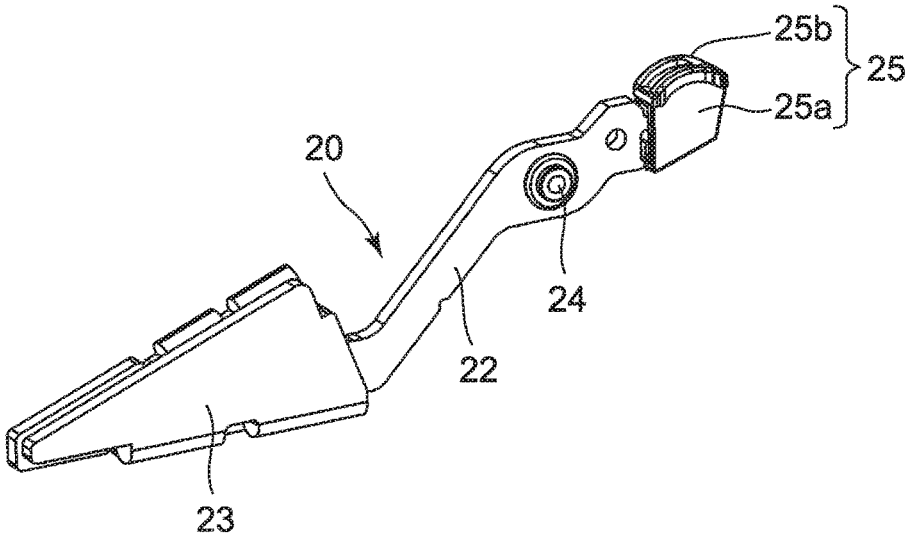
Figure 4B:
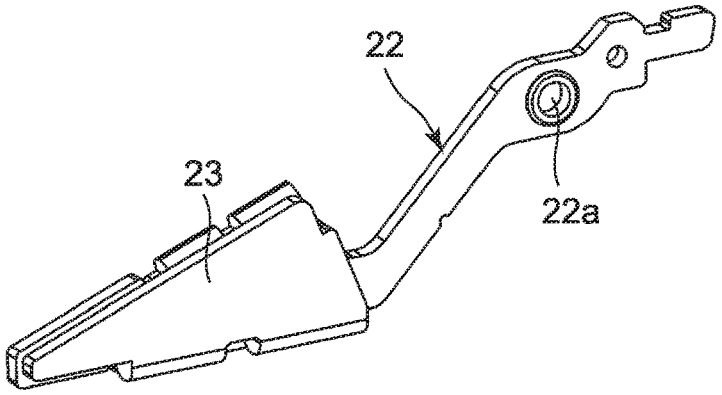
Figure 4C:
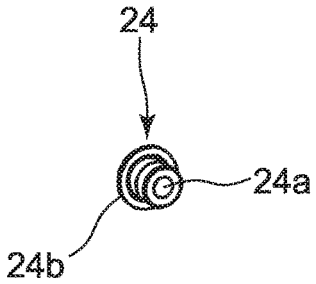

Each hammer member 20 for white keys includes a hammer body 22, a weight section 23 which is a load point and provided on the rear part (left part in FIG. 4A) of the hammer body 22, a rotation shaft section 24 which is a fulcrum that serves as the rotation center of the hammer body 22 and provided on the front side (right side in FIG. 4A) of the hammer body 22, and a key connecting section 25 which is an effort point and provided on a tip end (right end in FIG. 4A) of the hammer body 22 so as to be positioned further to the front than the rotation shaft section 24, as shown in FIG. 4A to FIG. 4C.

Figure 5A:
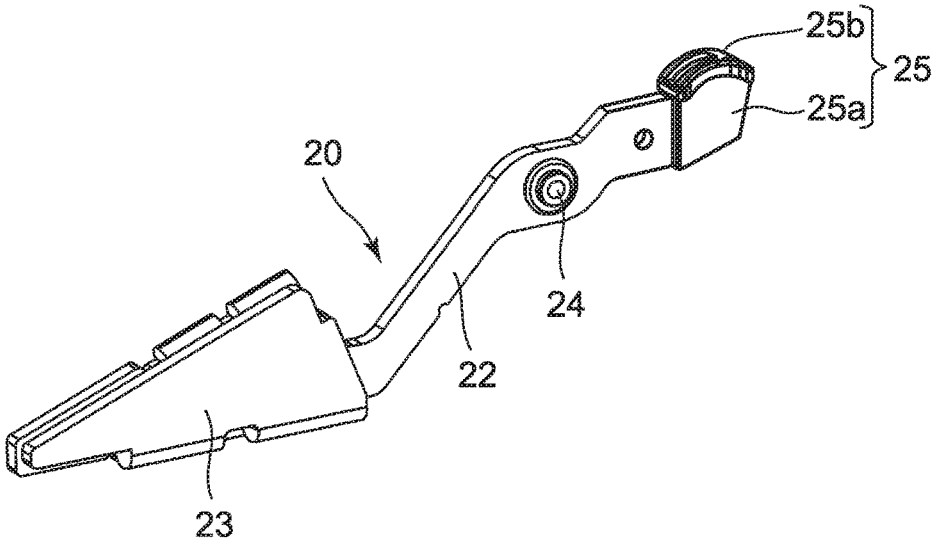
Figure 5B:
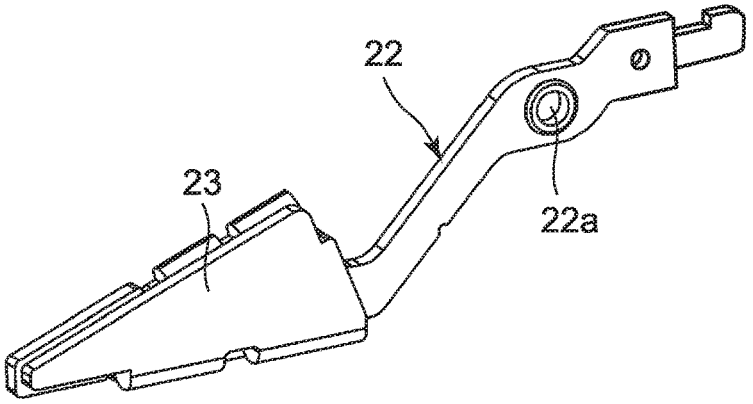
Figure 5C:
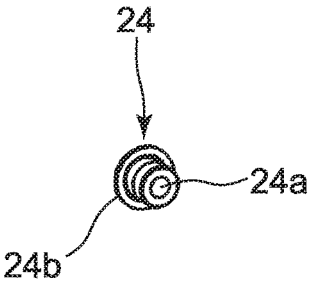

Similarly, each hammer member 20 for black keys includes a hammer body 22, a weight section 23 which is a load point and provided on the rear part (left part in FIG. 5A) of the hammer body 22, a rotation shaft section 24 which is a fulcrum that serves as the rotation center of the hammer body 22 and provided on the front side (right side in FIG. 5A) of the hammer body 22, and a key connecting section 25 which is an effort point and provided on a tip end (right end in FIG. 5A) of the hammer body 22 so as to be positioned further to the front than the rotation shaft section 24, as shown in FIG. 5A to FIG. 5C. The hammer members 20 for black keys are slightly different in shape from those for white keys.

Figure 6:
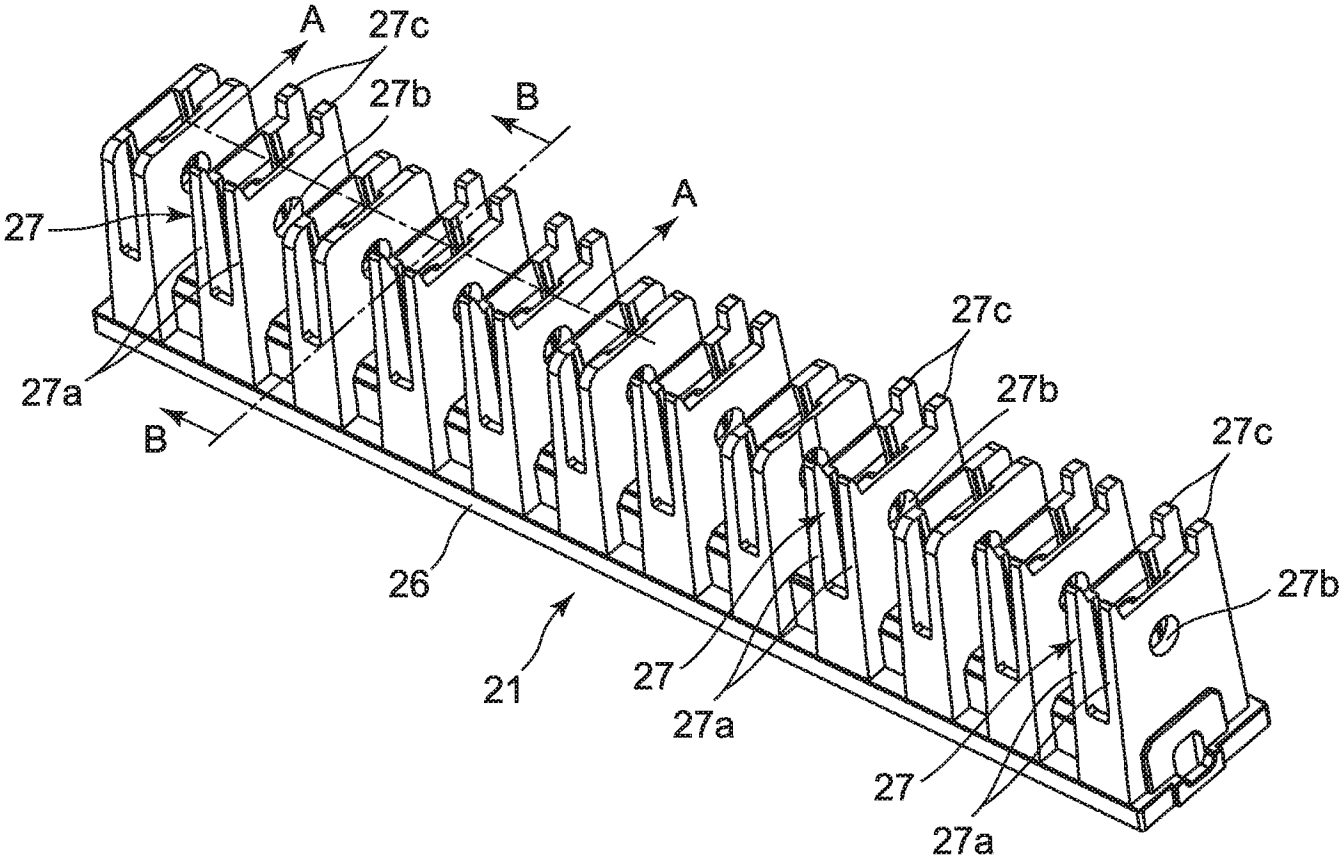
FIG. 6 is a perspective view of the hammer holder of the hammer unit shown in FIG. 3.

Also, each hammer holder 21 includes a base section 26 which has a pedestal shape and is arranged under the unit mounting section 7 of the keyboard chassis 1 along the array direction of the keys 2, and a plurality of hammer holding sections 27 which is provided on the upper surface of the base section 26 and rotatably holds the corresponding hammer members 20. Each of the plurality of hammer holding sections 27 includes a pair of holding pieces 27*a* which holds the rotation shaft section 24 of the hammer body 22 of the corresponding hammer member 20, and shaft receiving holes which are provided in the pair of holding pieces 27*a*, respectively, and the centers of which are located on the same axis, as shown in FIG. 3 and FIG. 6.

The hammer body 22 of each hammer member 20 is formed by press working or die-cutting on a metal plate, as shown in FIG. 4A to FIG. 4C and FIG. 5A to FIG. 5C. Also, the rotation shaft section 24 of each hammer member 20 is made of a highly rigid synthetic resin such as polyacetal (POM), and includes a shaft body 24*a* which is fitted into an attachment hole 22*a* formed in each hammer body 22 by die-cutting, and a flange section 24*b* having a brim shape and provided on the shaft body 24*a*.

The length of each shaft body 24*a* in its axial direction is slightly longer than the length between the pair of holding pieces 27*a* of each hammer holding section 27 on each hammer holder 21, and the end portions of each shaft body 24*a* are rotatably inserted into the shaft receiving holes 27*b* of the pair of holding pieces 27*a*, respectively, as shown in FIG. 4A to FIG. 8. Each flange section 24*b* is arranged on one side of the corresponding hammer body 22 where burrs occur on the rim of the attachment hole 22*a* in connection with the above-described die-cutting, and thereby prevents this side from coming in contact with the corresponding pair of holding pieces 27*a*.

Also, the key connecting section 25 of each hammer member 20, which is an effort point, includes a contact body section 25*a* which is fitted into the hammer connecting section 18 of the hammer pressing section 17 of the corresponding key 2, and a contact sliding section 25*b* having an arc-like shape which is provided on the upper surface of the contact body section 25*a* and on which the hammer connecting section 18 of the key 2 can be slid while coming in contact therewith, as shown in FIG. 1 to FIG. 5C. Each key connecting section 25 is made of a highly rigid synthetic resin such as polyacetal (POM), as with each rotation shaft section 24.

As a result, each hammer member 20 is structured such that, when its key connecting section 25 is depressed by the hammer pressing section 17 of the corresponding key 2 in response to a depression operation on the key 2 in a state where the shaft body 24*a* of its rotation shaft section 24 has been rotatably held by the pair of holding pieces 27*a* of the corresponding hammer holding section 27 on the corresponding hammer holder 21 and the contact body section 25*a* of the key connecting section 25 which is an effort point has been fitted into the hammer connecting section 18 of the hammer pressing section 17 of the key 2, the front and rear parts of its hammer body 22 are rotated around the shaft body 24*a* of the rotation shaft section 24 in the vertical direction, whereby the hammer member 20 applies an action load to the depressed key 2, as shown in FIG. 1 and FIG. 2.

That is, this hammer member 20 is structured such that its key connecting section 25 side projects from the hammer holder 21 toward the front side of the key 2 and its weight section 23 side projects from the hammer holder 21 toward the rear side of the key 2, as shown in FIG. 1 and FIG. 2. Also, this hammer member 20 is structured such that its projection length from the hammer holder 21 on the weight section 23 side is longer than its projection length from the hammer holder 21 on the key connecting section 25 side.

As a result, the hammer member 20 is structured such that, in a normal state, it is rotated counterclockwise around the shaft body 24*a* of the rotation shaft section 24 which is a fulcrum held by the hammer holding section 27 on the hammer holder 21 by the weight of the weight section 23 which is a load point, and its rear end (left end in FIG. 1) on the weight section 23 side comes in contact with the lower limit stopper 13 so as to regulate the rotation position, whereby the hammer pressing section 17 of the key 2 is pressed upward by the key connecting section 25 and the front end of the key 2 is set to be located at its initial position which is an upper-limit position, as shown in FIG. 1.

Also, this hammer member 20 is structured such that, when the key 2 is depressed from above, the key connecting section 25 which is an effort point is pressed downward against the weight of the weight section 23 which is a load point by the hammer pressing section 17 of the key 2, whereby the hammer member 20 is rotated clockwise around the rotation shaft section 24 held by the hammer holding section 27 on the hammer holder 21 so as to apply an action load to the key 2, as shown in FIG. 2.

Here, the hammer body 22 of the hammer member 20 is rotated clockwise around the shaft body 24*a* of the rotation shaft section 24 fitted into and held by the shaft receiving holes 27*b* of the pair of holding pieces 27*a* of the hammer holding section 27 on the hammer holder 21, and the weight section 23 on the rear end of the hammer body 22 comes in contact with an upper-limit stopper 13 such as felt provided on a rear portion of the undersurface of the board mounting section 8 of the keyboard chassis 1, whereby the rotation of the hammer member 20 is stopped, as shown in FIG. 2. That is, the rear end of the hammer member 20 is rotated between the lower-limit stopper 13 and the upper-limit stopper 28.

Here, the pair of holding pieces 27*a* of each hammer holding section 27 on each hammer holder 21 is described in detail. As shown in FIG. 7 and FIG. 8, the lower parts of the opposing surfaces of each pair of holding pieces 27*a* opposing each other are parallel to each other, and the upper parts of the opposing surfaces are inclined such that the length therebetween becomes larger toward their upper ends. That is, each hammer holding section 27 on each hammer holder 21 has a structure where the rotation shaft section 24 of the corresponding hammer member 20 can be easily inserted from above into its pair of holding pieces 27*a*.

Also, on each of the opposing surfaces of each pair of holding pieces 27*a*, a plurality of contact ribs 30 extending in the vertical direction is provided, as shown in FIG. 7 and FIG. 8. More specifically, these contact ribs 30 are provided in front of and behind the corresponding shaft receiving hole 27*b* and positioned extending from the lower parts of the pair of holding pieces 27*a* toward the upper parts. Also, each contact rib 30 excluding its upper part where the corresponding holding piece 27*a* is inclined is perpendicular to the upper surface of the base section 26 of the corresponding hammer holder 21 which is a horizontal surface, on which no draft is provided.

Here, the plurality of contact ribs 30 is further described in detail. As shown in FIG. 7 and FIG. 8, the length (width in FIG. 7B) of one contact rib 30 in the front-rear direction is a minimum length sufficiently shorter than the inner diameter of the corresponding shaft receiving hole 27*b*. That is, the plurality of contact ribs 30 is formed such that the contact areas of the corresponding hammer member 20 with respect to the pair of holding pieces 27*a* of the corresponding hammer holding section 27 are small. Moreover, on corner portions of the plurality of contact ribs 30 in the front-rear direction, arc-shaped chamfers (not shown) are provided. As a result, the plurality of contact ribs 30 is formed such that, although no draft is provided, die-cutting from a molding die can be easily performed.

Each hammer holding section 27 of each hammer holder 21 is structured such that, in a state where both ends of the shaft body 24*a* of the rotation shaft section 24 of the corresponding hammer member 20 have been inserted into the shaft receiving holes 27*b* of its pair of holding pieces 27*a*, the flange section 24*b* arranged on the surface of the hammer body 22 of the hammer member 20 on the burr side is positioned between the plurality of contact ribs 30 on one holding piece 27*a*, as shown in FIG. 8. Also, each hammer holding section 27 is structured such that, when the corresponding hammer member 20 is rotated in response to a key depression operation, the contact ribs 30 of its pair of holding pieces 27*a* which hold the hammer member 20 therebetween restricts the movement of the hammer member 20 in the horizontal direction (the array direction of the keys 2).

Accordingly, by the contact ribs 30, the contact areas of the hammer member 20 with respect to the pair of holding pieces 27*a* of the hammer holding section 27 are small. That is, the hammer holding section 27 is structured to prevent the lateral displacement of the hammer member 20 and favorably holds the hammer member 20 with the frictional resistance between the pair of holding pieces 27*a* and the hammer member 20 being reduced, as shown in FIG. 8.

Also, in one of the opposing surfaces of each pair of holding pieces 27*a*, or more specifically, in one of the opposing surfaces where the above-described flange section 24*b* does not come in contact, a step recess section 31 is provided in an area around the corresponding shaft receiving hole 27*b* and between the corresponding contact ribs 30, as shown in FIG. 7B. This step recess section 31 is an oil sump where lubricant such as grease is stored. By both sides of the step recess section 31 in the front-rear direction being enclosed by the contact ribs 30, the outflow of lubricant is prevented and the lubrication performance by the lubricant is maintained for a long period of time.

Figure 7A:
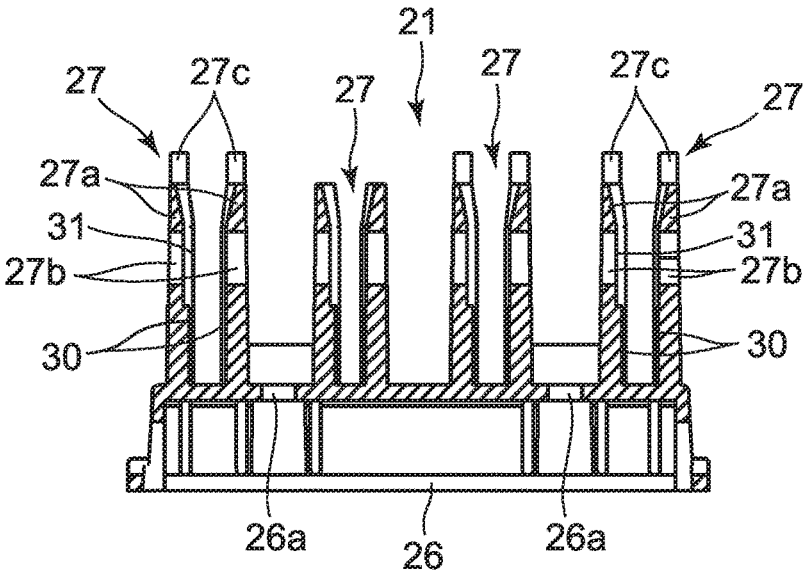
Figure 7B:
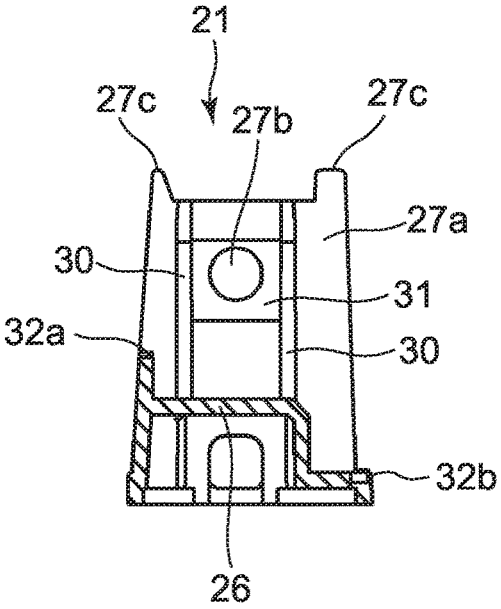
Figure 8:
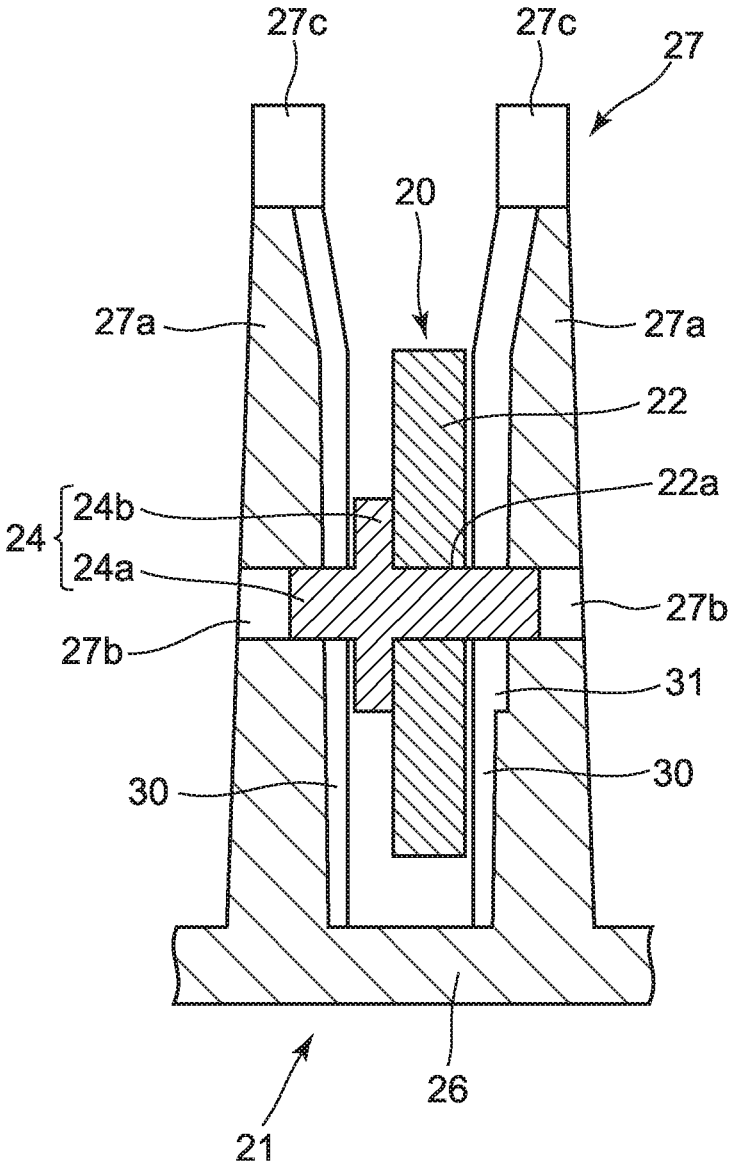
FIG. 8 is a partial sectional view showing a state where a hammer member has been attached to the hammer holder.

On upper end portions of the front and rear parts of each holding piece 27*a*, supporting projections 27*c* which are identifiers are selectively provided, as shown in FIG. 6, FIG. 7A and FIG. 7B. These supporting projections 27*c* are provided on the upper ends of each pair of holding pieces 27*a* that holds a hammer member 20 for a white key, and positioned higher than the upper ends of each pair of holding pieces 27*a* that holds a hammer member 20 for a black key.

As a result, when hammer members 20 for white keys and hammer members 20 for black keys are to be attached to a hammer holder 21, these supporting projections 27*c* serve as markers for identifying, for each pair of holding pieces 27*a*, a hammer member 20 to be attached from among the hammer members 20 for white keys and the hammer members 20 for black keys.

Figure 10:
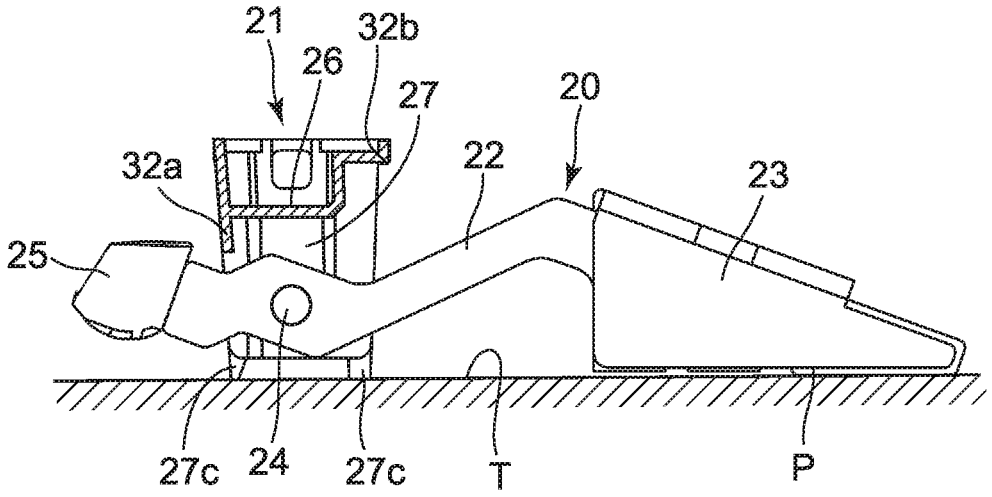
FIG. 10 is a diagram showing a state where the hammer holder and the hammer member in FIG. 9 have been vertically inverted and placed on a placement surface of a working table.

Here, each hammer holder 21 includes, for example, five hammer members 20 for black keys and seven hammer members 20 for white keys, as shown in FIG. 3. Therefore, the above-described supporting projections 27*c* should preferably be provided on holding pieces 27*a* for white keys on each hammer holder 21 although they may be provided on holding pieces 27*a* for black keys on each hammer holder 21. This is because, in that case, the number of the contact points of each hammer unit 3 with respect to a placement surface T when it is vertically inverted and placed on the placement surface T is larger and therefore each inverted hammer unit 3 becomes better balanced on the placement surface T, as shown in FIG. 10.

Figure 9:
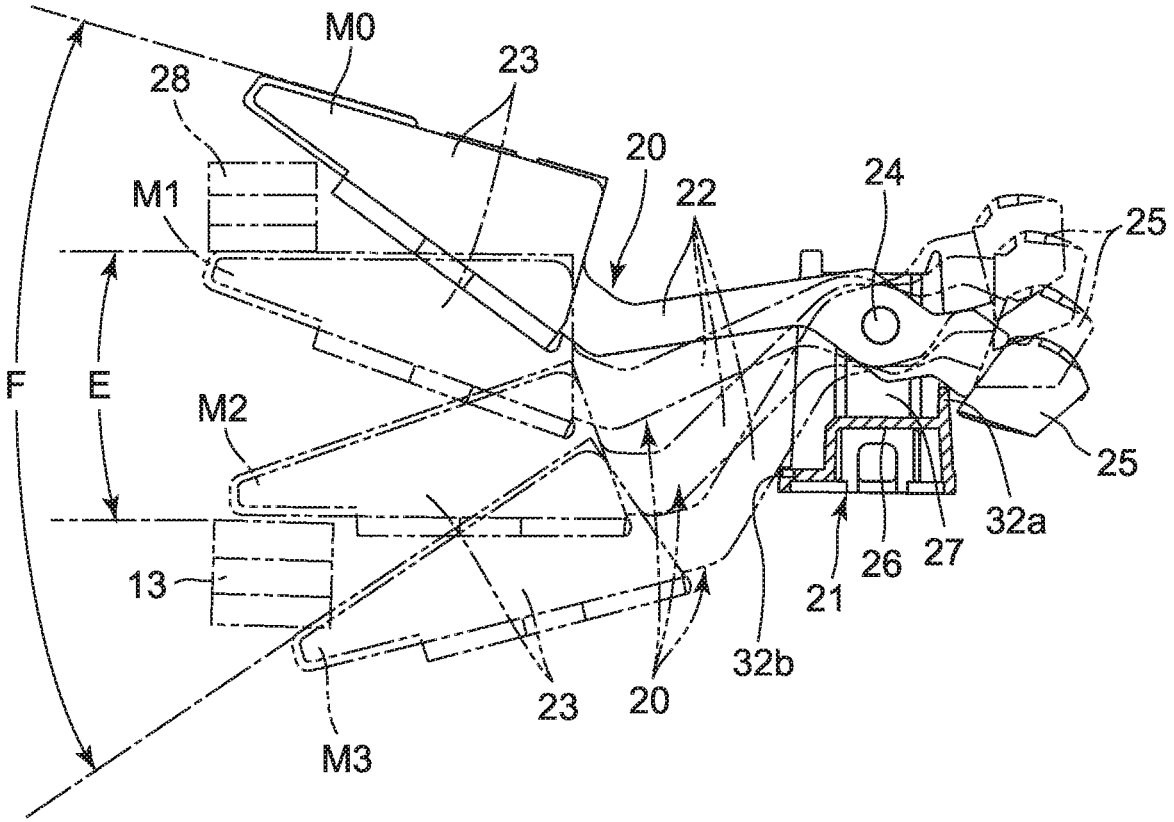
FIG. 9 is a diagram showing the rotation range of a hammer member with respect to the hammer holder.

As shown in FIG. 9, before the hammer holders 21 holding the hammer members 20 are mounted on the keyboard chassis 1, each hammer member 20 can be freely rotated within the range of M0 to M3, which is referred to as a free rotation range F. That is, each hammer holding section 27 includes a first hammer restriction section 32*a* which is a restriction member for restricting the corresponding hammer member 20 not to move to an area above the M0 point, and a second hammer restriction section 32*b* which is a restriction members for restricting the corresponding hammer member 20 not to move to an area below the M3 point.

Note that, in a state where the hammer holders 21 have been mounted on the keyboard chassis 1, the rotation range of each hammer member 20 is restricted by the lower-limit stopper 13 and the upper-limit stopper 28, so that each hammer member 20 is rotated only within the range of M1 to M2, as shown in FIG. 9. This range of M1 to M2 is referred to as a restriction range E which is a rotation restriction range.

That is, "M0" which is the upper limit of the free rotation range F where each hammer member 20 can be freely rotated is located outside of the restriction range E. Therefore, the above-described first hammer restriction section 32*a* does not affect the rotation of the corresponding hammer member 20 performed in response to the instrument player's key depression operation. Also, "M3" which is the lower limit of the free rotation range F where each hammer member 20 can be freely rotated is also located outside of the restriction range E. Therefore, the above-described second hammer restriction section 32*b* does not affect the rotation of the corresponding hammer member 20 performed in response to the instrument player's key depression operation.

Figure 11:
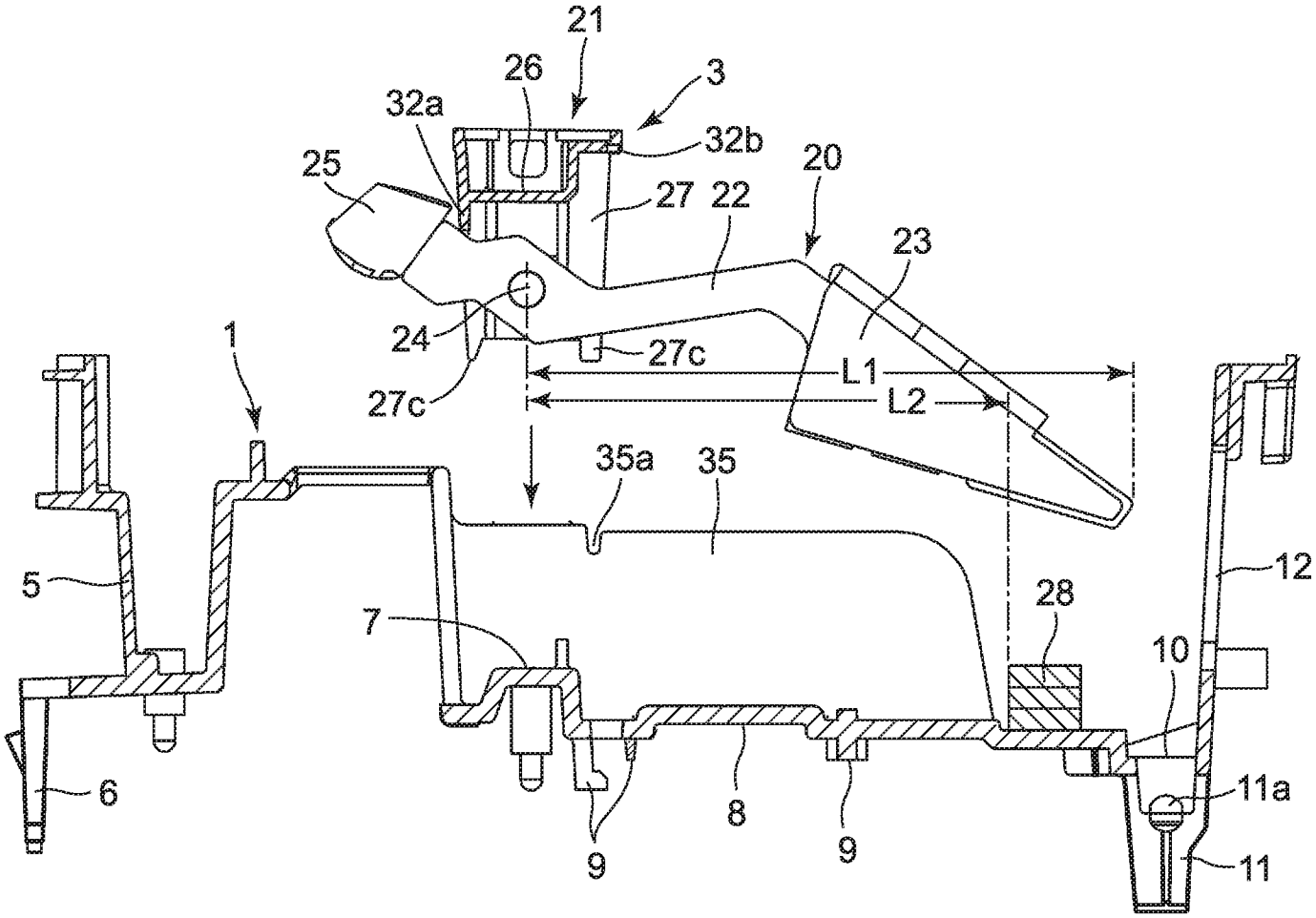
FIG. 11 is a diagram showing a state where the hammer holder and the hammer member in FIG. 10 are being mounted from above on a vertically inverted keyboard chassis.

Among these first and second hammer restriction sections 32*a* and 32*b*, the first hammer restriction section 32*a* is a contact point on the effort point side, that is, a contact point on the key connection section 25 side, as shown in FIG. 11. When the hammer holder 21 is vertically inverted and lifted with the hammer member 20 being rotatably attached, a portion between the rotation shaft section 24 which is the fulcrum of the hammer body 22 and the key connecting section 25 which is the effort point comes in contact with the first hammer restriction section 32*a*. As a result, the rotation of the hammer member 20 is restricted, and the hanging down of the weight section 23 side of the hammer member 20 is suppressed as compared to a structure having no first hammer restriction section 32*a*.

That is, the first hammer restriction section 32*a* restricts the rotation of the hammer member 20 such that the hanging down of the weight section 23 side of the hammer member 20 is suppressed as compared to a structure having no first hammer restriction section 32*a*, and thereby holds the hammer member 20 on the hammer holder 21 in a substantially horizontal state, as shown in FIG. 11. That is, this first hammer restriction section 32*a* which is a contact point on the effort point side enables the hammer holder 21 where the hammer member 20 has been attached to be easily mounted on the keyboard chassis 1.

Also, in a case where the hammer holder 21 where the hammer member 20 has been rotatably attached is vertically inverted and placed on the placement surface T of an assembling work table or the like, an undersurface portion of the hammer member 20 on the weight section 23 side and the supporting projections 27*c* on each holding piece 27*a* come in contact with the placement surface T, whereby the hammer holder 21 is stably placed, as shown in FIG. 10.

Also, the hammer body 22 of the hammer member 20 is not in contact with the first and second hammer restriction sections 32*a* and 32*b* when the hammer member 20 is rotated around the shaft body 24*a* of the rotation shaft section 24 with the shaft body 24*a* being supported in the shaft receiving holes 27*b* in the pair of holding pieces 27*a* of the hammer holding section 27 and the undersurface portion of the hammer member 20 on the weight section 23 side comes in contact with the placement surface T, as shown in FIG. 10. By this structure as well, the hammer holder 21 is stably placed on the placement surface T.

In the present embodiment, when one of the hammer holders 21 where hammer members 20 have been rotatably attached is vertically inverted and placed on a placement surface T, among the plurality of supporting projections 27*c* on the pairs of holding pieces 27*a* of the hammer holder 21, supporting projections 27*c* on pairs of holding pieces 27*a* holding hammer members 20 for white keys are placed on and come in contact with the placement surface T, and an undersurface portion of each hammer member 20 on its weight section 23 side is placed on the placement surface T, as shown in FIG. 10, Also, each weight section 23 has a substantially triangle shape, and its upper side (lower side in FIG. 10) has a flat surface so as to be stably placed on a placement surface T when the corresponding hammer unit 3 is vertically inverted and placed on the placement surface T, as shown in FIG. 10

On the other hand, the above-described second hammer restriction section 32*b* is a contact point on the load point side, that is, a contact point on the weight section 23 side, and restricts the rotation limit of one side of the hammer member 20 to the M3 point when the hammer member 20 is freely rotated within the free rotation range F of M0 to M3, as shown in FIG. 9. That is, in a state where the hammer unit 3 has not been mounted on the keyboard chassis 1, the hammer member 20 is rotated from a position corresponding to the second hammer restriction section 32*b* which is the contact point on the load point side to a position corresponding to the first hammer restriction section 32*a* which is the contact point on the effort point side within the free rotation range F. Then, in a state where the hammer unit 3 has been mounted on the keyboard chassis 1, the hammer member 20 is rotated within the restriction range E in response to a key depression operation, without the hammer body 22 coming in contact with the first and the second hammer restriction sections 32*a* and 32*b*.

Figure 13A:
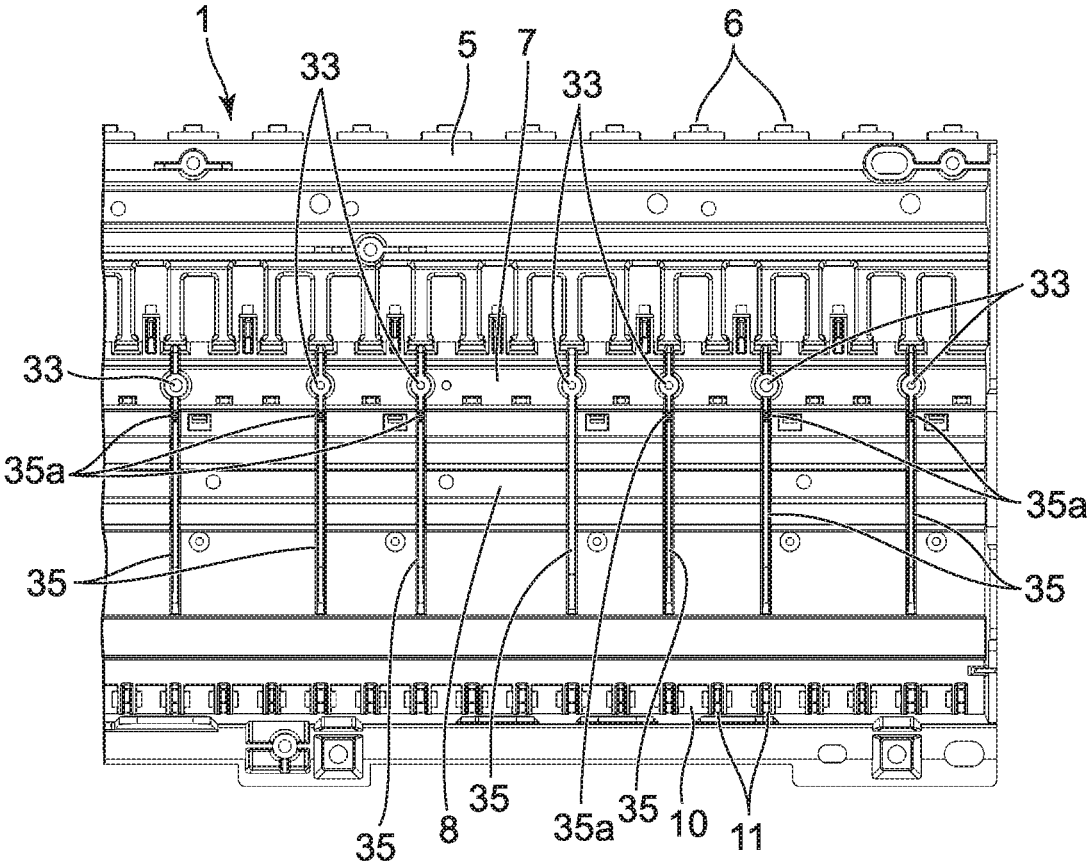
Figure 13B:
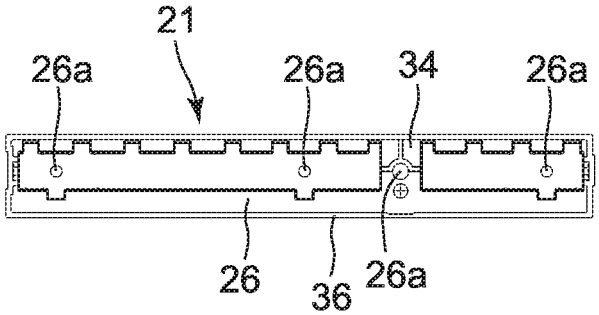

Also, each hammer holder 21 is attached to the undersurface of the unit mounting section 7 of the keyboard chassis 1 by screws (not shown) with it rotatably holding a plurality of hammer members 20, as shown in FIG. 13A and FIG. 13B. More specifically, each hammer holder 21 is attached to the undersurface of the unit mounting section 7 of the keyboard chassis 1 by screws being inserted into screw insertion holes 26*a* in its base section 26 which correspond to substantially cylindrical mounting bosses 33 provided on the undersurface of the unit mounting section 7, and screwed into the mounting bosses 33.

Moreover, each hammer holder 21 includes a first positioning section 34 whose position is determined by one of the mounting bosses 33 provided on the undersurface of the unit mounting section 7 of the keyboard chassis 1, and a second positioning section 36 whose position is determined by reinforcing ribs 35 provided extending from the unit mounting section 7 of the keyboard chassis 1 to the board mounting section 8, as shown in FIG. 13A and FIG. 13B.

The plurality of mounting bosses 33 of the keyboard chassis 1 is provided on the undersurface of the unit mounting section 7 of the keyboard chassis 1 at predetermined intervals along the array direction of the keys 2. Also, the plurality of reinforcing ribs 35 of the keyboard chassis 1 is provided at predetermined intervals along the array direction of the keys 2 and extends from the unit mounting section 7 to the board mounting section 8.

The above-described first positioning section 34 is a clearance where one of the mounting bosses 33 of the keyboard chassis 1 is inserted. As a result of one of the mounting bosses 33 of the keyboard chassis 1 being inserted into this clearance, the first positioning section 34 positions its hammer holder 21 to be at the right position in the array direction of the keys 2. Also, the above-described second positioning section 36 is an engaging projection which engages with notch sections 35*a* provided on predetermined reinforcing ribs 35 of the keyboard chassis 1. By this engaging projection being engaged with the notch sections 35*a* of the reinforcing ribs 35, its hammer holder 21 is set to be at the right position in the front-rear direction of the keys 2.

Next, the mechanism of this keyboard instrument is described.

In the assembly of the keyboard instrument, first, the hammer members 20 are produced. Then, these hammer members 20 are mounted on the hammer holders 21, whereby each hammer unit 3 is assembled. In the production of each hammer member 20, the hammer body 22, the weight section 23, and the attachment hole 22*a* of the hammer body 22 are formed by press working or die-cutting on a metal plate. Then, the rotation shaft section 24 is attached to the attachment hole 22*a* of the hammer body 22, and the key connecting section 25 is attached to a tip end of the hammer body 22.

When the rotation shaft section 24 is to be attached to the attachment hole 22*a* of the hammer body 22, the shaft body 24*a* of the rotation shaft section 24 is fitted into the attachment hole 22*a* from the burr side of the hammer body 22 where burrs have occurred on the outer periphery and rim of the attachment hole 22*a* by the die-cutting, and the flange section 24*b* of the rotation shaft section 24 is pressed against the burr side surface of the hammer body 22.

As a result, even though the burrs have occurred on the rim of the attachment hole 22*a* of the hammer body 22, the shaft body 24*a* of the rotation shaft section 24 can be attached to the attachment hole 22*a* of the hammer body 22 with the burrs being covered by the flange section 24*b* of the rotation shaft section 24.

Also, when the key connecting section 25 is to be attached to the tip end of the hammer body 22, the contact body section 25*a* of the key connecting section 25 is fitted into the tip end of the hammer body 22 with the arc-shaped contact sliding section 25*b* on the upper surface of the contact body section 25*a* of the key connecting section 25 being oriented upward. As a result, the key connecting section 25 is attached to the tip end of the hammer body 22. By the above-described procedure being performed for each hammer member 20, each hammer member 20 is assembled.

When hammer members 20 assembled as described above are to be attached to a hammer holder 21, first, lubricant such as grease is applied to the step recess section 31 in one of the opposing surfaces of the pair of holding pieces 27*a* of each hammer holding section 27. In this state, the hammer members 20 are attached to the hammer holder 21 such that a hammer member 20 for a white key or a hammer member 20 for a black key is selected for each pair of holding pieces 27*a* and attached to the hammer holder 21, by the supporting projections 27*c* which are identifiers provided on the pairs of holding pieces 27*a* of the predetermined hammer holding sections 27 being used as markers for the selection.

That is, on a tall pair of holding pieces 27*a* having supporting projections 27*c*, a hammer member 20 for a white key is mounted. On a short pair of holding pieces 27*a* having no supporting projections 27*c*, a hammer member 20 for a black key is mounted. When each hammer member 20 is to be attached to the hammer holder 21, the rotation shaft section 24 of the hammer body 22 thereof is inserted from above between the pair of holding pieces 27*a* of the corresponding hammer holding section 27, whereby both ends of the shaft body 24*a* of the rotation shaft section 24 are inserted into the shaft receiving holes 27*b* of the pair of holding pieces 27*a*.

Here, since the upper parts of the opposing surfaces of the pair of holding pieces 27*a* have been inclined such that the length therebetween becomes larger toward their upper ends, the shaft body 24*a* of the rotation shaft section 24 can be easily inserted between the pair of holding pieces 27*a* by pressing them apart. In this state where the rotation shaft section 24 is between the pair of holding pieces 27*a*, the flange section 24*b* of the rotation shaft section 24 arranged on the burr side of the hammer body 22 is positioned between the burr side surface of the hammer body 22 and a surface of one of the holding pieces 27*a* opposing it. As a result, the burr side surface of the hammer body 22 is prevented from coming in contact with the surface of one of the holding pieces 27*a* opposing it.

Also, on the opposing surfaces of the pair of holding pieces 27*a*, the contact ribs 30 have been provided extending in the vertical direction. Accordingly, the flange section 24*b* on the burr side surface of the hammer body 22 is arranged with it being in contact with the contact ribs 30 of one of the holding pieces 27*a*. In addition, the side surface of the hammer body 22 opposite to the burr side is arranged with it being in contact with the contact ribs 30 of the other one of the holding pieces 27*a*.

Moreover, each of the plurality of contact ribs 30 excluding its upper part is perpendicular to the upper surface of the base section 26 of the hammer holder 21 which is a horizontal surface, and no draft has been provided thereon. Accordingly, the flange section 24*b* arranged on the burr side surface of the hammer body 22 is evenly pressed against the contact ribs 30 of one of the holding pieces 27*a* and the side surface of the hammer body 22 opposite to the burr side is evenly pressed against the contact ribs 30 of the other one of the holding pieces 27*a*.

That is, the flange section 24*b* of the rotation shaft section 24 and the side surface of the hammer body 22 opposite to the burr side come in contact with the contact ribs 30 of the pair of holding pieces 27*a*, whereby the contact areas of the hammer member 20 with respect to the pair of holding pieces 27*a* of the hammer holding section 27 are small. This structure reduces the frictional resistance between the pair of holding pieces 27*a* and the hammer member 20 and prevents the lateral displacement of the hammer member 20. As a result, the hammer member 20 is rotatably held by the hammer holder 21 unfailingly and favorably. By the above-described procedure being performed for each hammer member 20, one hammer unit 3 is assembled.

When this hammer unit 3 assembled as described above is to be mounted on the keyboard chassis 1, first, the hammer unit 3 and the keyboard chassis 1 are vertically inverted. More specifically, the hammer holder 21 and the plurality of hammer members 20 are vertically inverted and placed on the placement surface T of an assembling work table or the like, as shown in FIG. 10. In addition, the keyboard chassis 1 is vertically inverted and placed on the placement surface T of the assembling work table or the like, as shown in FIG. 11.

Here, the supporting projections 27*c* provided on the upper ends of each pair of holding pieces 27*a* holding a hammer member 20 for a white key are arranged on the placement surface T. In this state, each hammer member 20 is rotated around the shaft body 24*a* of its rotation shaft section 24 by the weight of its weight section 23, and a portion of the undersurface thereof on the weight section 23 side comes in contact with the placement surface T.

Also, here, the shaft body 24*a* of the rotation shaft section 24 is supported by the shaft receiving holes 27*b* in the pair of holding pieces 27*a* of the corresponding hammer holding section 27, and each hammer member 20 is held on the hammer holder 21 with the key connecting section 25 side of its hammer body 22 not being in contact with the corresponding first and second hammer restriction sections 32*a* and 32*b*, as shown in FIG. 10. As a result, each hammer member 20 and the hammer holder 21 are stably placed on the placement surface T.

In this state, when the hammer holder 21 is lifted from the placement surface T by an automatic assembly machine (not shown), each hammer member 20 is rotated around the shaft body 24*a* of its rotation shaft section 24 by the weight of its weight section 23. However, its hammer body 22 comes in contact with the corresponding first hammer restriction section 32*a* of the hammer holder 21 which is a contact point on the effort point side, whereby the rotation of this hammer member 20 is restricted, as shown in FIG. 11.

That is, the hanging down of the weight section 23 side of each hammer member 20 is suppressed at a minimum by the corresponding first hammer restriction section 32*a* which is a restriction member and a contact point on the effort point side. Accordingly, each hammer member 20 is held in a substantially horizontal state with respect to the hammer holder 21 so that the hammer holder 21 having the hammer members 20 attached thereto can be easily mounted on the keyboard chassis 1 by the automatic assembly machine.

Then, the vertically inverted hammer holder 21 having the plurality of hammer members 20 attached thereto is mounted on the upper surface (undersurface in FIG. 1) of the unit mounting section 7 of the vertically inverted keyboard chassis 1. Here, the plurality of hammer members 20 have been substantially horizontally held on the hammer holder 21 by the first hammer restriction sections 32*a*, and therefore do not significantly hang down. Accordingly, the mounting operation is not interrupted by the plurality of hammer members 20 significantly hanging down, so that the hammer holder 21 can be favorably mounted on the upper surface of the unit mounting section 7 of the keyboard chassis 1.

Here, the position of the hammer holder 21 on the keyboard chassis 1 is determined by the first and second positioning sections 34 and 36. More specifically, the first positioning section 34 restricts the position of the hammer holder 21 in the arrangement direction of the keys 2 as a result of one of the mounting bosses 33 of the keyboard chassis 1 being inserted into this first positioning section 34. The second positioning section 36 restricts the position of the hammer holder 21 in the front-rear direction of the keys 2 by engaging with the notch sections 35*a* provided in the predetermined reinforcing ribs 35 of the keyboard chassis 1.

Figure 12:
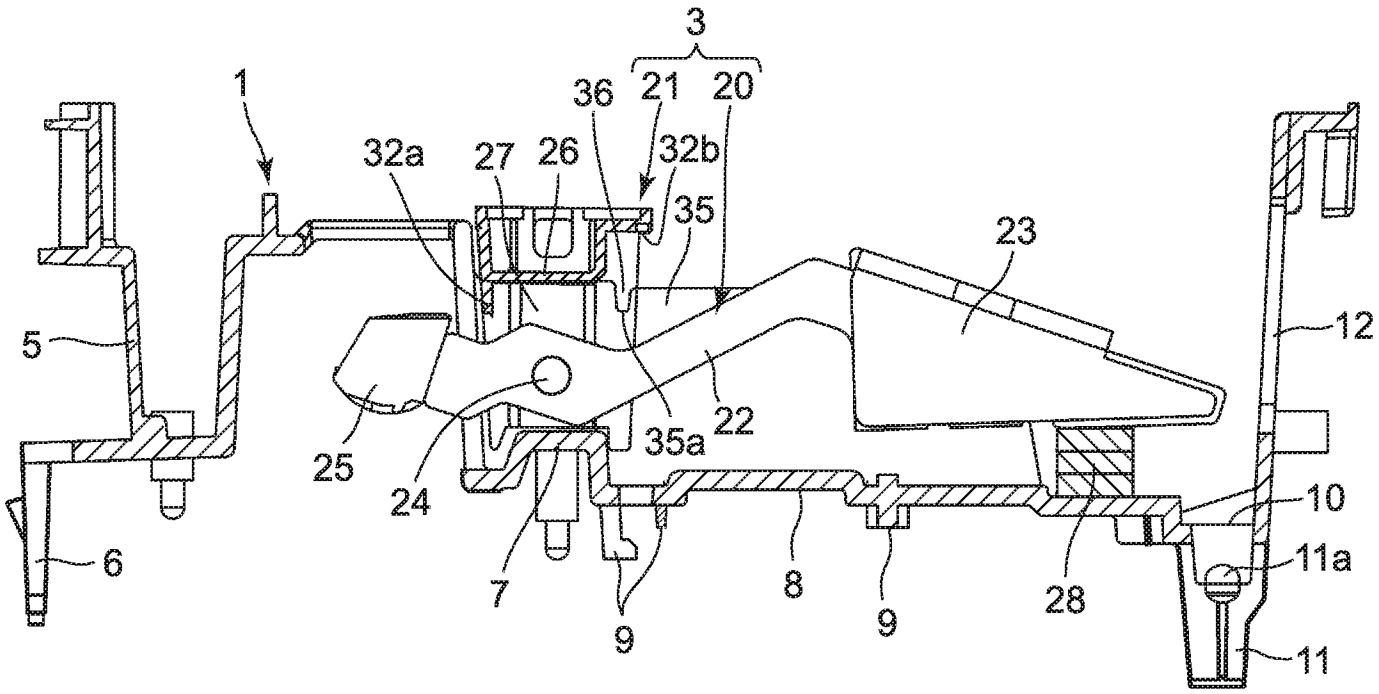
FIG. 12 is a diagram showing a state where the hammer holder and the hammer member in FIG. 10 have been mounted on the vertically inverted keyboard chassis.

As a result, the screw insertion holes 26*a* provided in the base section 26 of the hammer holder 21 are guided to positions corresponding to the substantially cylindrical mounting bosses 33 provided in the undersurface of the unit mounting section 7. Then, in this state, screws (not shown) are inserted into the screw insertion holes 26*a* in the base section 26 of the hammer holder 21, and screwed into and attached to the mounting bosses 33, whereby the hammer holder 21 is attached to the unit mounting section 7 of the keyboard chassis 1, as shown in FIG. 12. By the above-described procedure being performed for each hammer holder 21, all the hammer holders 21 are attached to the unit mounting section 7.

Then, the hammer units 3 and the keyboard chassis 1 are vertically inverted to be in their ordinary states. Then, in this state, each switch section 4 is attached to the board mounting section 8 of the keyboard chassis 1. Here, before this attachment, the rubber sheet provided with the dome-shaped bulging sections 16 is attached on the switchboard 15, and the front and rear ends of the switch board 15 are arranged on the board supporting sections 9 provided on the board mounting section 8.

Then, the plurality of keys 2 is attached to the keyboard chassis 1. Here, first, the key guiding sections 6 of the keyboard chassis 1 are inserted into the front ends of the keys 2. Subsequently, the contact sliding section 25*b* of the key connecting section 25 of each hammer member 20 is inserted into the corresponding hammer connecting section 18 provided in the lower part of the hammer pressing section 17 of the corresponding key 2. Then, in this state, the rear ends of the keys 2 are attached to the key supporting sections 11 of the keyboard chassis 1 by the key supporting shafts 11*a* in a manner to be rotatable in the vertical direction.

When the key guiding sections 6 are inserted into the front parts of the keys 2 and the contact sliding sections 25*b* of the key connecting sections 25 of the hammer members 20 are inserted into the hammer connecting sections 18 in the lower parts of the hammer pressing sections 17 of the keys 2 as described above, the switch pressing sections 14 of the keys 2 are arranged at positions corresponding to the bulging sections 16 of the switch sections 4 on the keyboard chassis 1, whereby the assembly of the keyboard instrument is completed.

Next, the use of the keyboard instrument assembled as described above is described.

First, in the initial state where no key 2 has been depressed, each hammer member 20 has been rotated counterclockwise around the shaft body 24*a* of the rotation shaft section 24 of its hammer body 22 by the weight of its weight section 23 and the rear end of each hammer member 20 has come in contact from above with the lower limit stopper 13 provided near the lower end of the rear leg section 12 of the keyboard chassis 1, as shown in FIG. 1. Therefore, the rotation position of each hammer member 20 has been restricted to the M2 point.

In addition, the hammer bodies 22 are positioned away from and not in contact with the second hammer restriction sections 32*b* of the hammer holders 21, as shown in FIG. 1. Moreover, the hammer connecting sections 18 of the hammer pressing sections 17 of the keys 2 have been pressed upward by the key connecting sections 25 on the tip ends (right ends in FIG. 1) of the hammer bodies 22, and each key 2 has been rotated counterclockwise around the key supporting shaft 11*a* of the corresponding key supporting section 11 provided on the key mounting section 10 of the keyboard chassis 1, so that the front end of each key 2 has been set to be at its upper-limit position. In this state, the switch pressing sections 14 of the keys 2 are positioned away from and above the switch sections 4.

Then, when a key depression operation is performed on a key 2 in this state, this key 2 is rotated clockwise around the key supporting shaft 11*a* of the corresponding key supporting section 11, and the hammer connecting section 18 of the hammer pressing section 17 of the key 2 depresses the key connecting section 25 of the corresponding hammer member 20, as shown in FIG. 2. As a result, the hammer member 20 is rotated clockwise against the weight of its weight section 23. Here, an action load is applied to the key 2 by the rotation of the hammer member 20, whereby the key depression load becomes heavy.

Then, when the hammer member 20 is further rotated clockwise by this key depression operation, the rear end (left end in FIG. 2) of its hammer body 22 approaches the upper-limit stopper 28 such as felt on the undersurface of the key mounting section 10 of the keyboard chassis 1 from below. Here, the corresponding switch section 4 is pressed by the switch pressing section 14 of the key 2, and its bulging section 16 on the rubber sheet is elastically deformed, whereby an ON signal is outputted by the switch section 4.

Consequently, musical sound information is generated by the sound emission section 15*a* based on the ON signal from the switch section 4, and a musical sound is emitted from the speaker (not shown) based on the generated musical sound information. Then, the rear end (left end in FIG. 2) of the hammer body 22 comes in contact with the upper-limit stopper 28 such as felt on the undersurface of the key mounting section 10 of the keyboard chassis 1 from below, whereby the rotation position of the hammer member 20 is restricted to the upper-limit position M1 and the rotation of the hammer member 20 is stopped. Here, the hammer member 20 is positioned away from and not in contact with the corresponding first hammer restriction section 32*a* of the corresponding hammer holder 21.

Then, when a key release operation is started by the pressing finger being released from the key 2, the hammer member 20 is started to be rotated counterclockwise around the shaft body 24*a* of its rotation shaft section 24 by the weight of the weight section 23, and the key 2 is started to be rotated counterclockwise around the key support shaft 11*a* of the key supporting section 11 by the elastic return force of the bulging section 16 of the switch section 4.

Then, when the hammer member 20 is further rotated counterclockwise around the shaft body 24*a* of the rotation shaft section 24 and the key 2 is further rotated counterclockwise around the key supporting shaft 11*a* of the key supporting section 11, the rear end of the hammer body 22 on the weight section 23 side comes in contact from above with the lower-limit stopper 13 provided near the lower end of the rear leg section 12 of the keyboard chassis 1.

The key 2 is rotated counterclockwise around the key supporting shaft 11*a* of the key supporting section 11 by the hammer connecting section 18 of the hammer pressing section 17 being pressed upward by the key connecting section 25 on the tip end (right end in FIG. 1) of the hammer body 22, and the front end of the key 2 is set to be at its upper-limit position, as shown in FIG. 1. In this state, the key 2 is at the initial position again, the hammer body 22 is not in contact with the corresponding second hammer restriction section 32*b*, and the switch pressing section 14 of the key 2 is positioned away from and above the switch section 4.

When the rotation shaft section 24 of the hammer member 20 is rotating centering on the shaft receiving holes 27*b* of the pair of holding pieces 27*a* of the corresponding hammer holding section 27 on the hammer holder 21 as described above, the flange section 24*b* of the rotation shaft section 24 is being pressed against the burr side surface of the hammer body 22. Accordingly, even though the burr is on the rim of the attachment hole 22*a* of the hammer body 22, the effect of the burr can be prevented by the burr being covered by the flange section 24*b*.

Also, the hammer member 20 is held by the hammer holding section 27 by the rotation shaft section 24 being held between the pair of holding pieces 27*a* with both ends of the shaft body 24*a* of the rotation shaft section 24 being inserted into the shaft receiving holes 27*b* in the pair of holding pieces 27*a* of the hammer holding section 27. That is, the flange section 24*b* has been arranged between the burr side surface of the hammer body 22 and a surface of one of the holding pieces 27*a* opposing the burr side surface. As a result, the burr side surface of the hammer body 22 and the surface of one of the holding pieces 27*a* opposing it are not in contact with each other, so that this holding piece 27*a* is not scraped by the rotation of the hammer member 20.

Moreover, each contact rib 30 provided on the opposing surfaces of the pair of holding pieces 27*a* is, except for its inclined upper part, perpendicular to the upper surface of the base section 26 of the hammer holder 21 which is a horizontal surface, and no draft has been provided thereon. Therefore, when the rotation shaft section 24 of the hammer member 20 is held between the pair of holding pieces 27*a*, the flange section 24*b* arranged on the burr side surface of the hammer body 22 is evenly pressed against the contact ribs 30 of one holding piece 27*a*, and a surface of the hammer body 22 on the side opposite to the burr side is evenly pressed against the contact ribs 30 of the other holding piece 27*a*.

Accordingly, the contact areas of the hammer member 20 with respect to the pair of holding pieces 27*a* of the hammer holding section 27 when the hammer member 20 is held by the hammer holding section 27 and rotated are small. As a result, the frictional resistance between the pair of holding pieces 27*a* and the hammer member 20 is reduced, and the horizontal displacement of the hammer member 20 is prevented, whereby the hammer member 20 is smoothly rotated with it being favorably held by the hammer holder 21.

Here, lubricant such as grease has been applied to the corresponding step recess section 31 provided in an area around a shaft receiving hole 27*b* and between contact ribs 30 on one of the opposing surfaces of the pair of holding pieces 27*a*. By this structure as well, the hammer member 20 is smoothly and favorably rotated when it is held by the hammer holding section 27 and rotated. Also, by both sides of this step recess section 31 in the front-rear direction being enclosed by the contact ribs 30, the outflow of the lubricant is prevented and the lubrication performance by the lubricant is maintained for a long period of time.

As described above, this keyboard instrument includes the hammer units 3 and the keyboard chassis 1. Each hammer unit 3 includes the plurality of hammer members 20 each of which has the key connecting section 25 that is an effort point on one end side, the weight section 23 that is a load point on the other end side, and the rotation shaft section 24 that is a fulcrum between the key connecting section 25 and the weight section 23, and the hammer holder 21 which rotatably holds these hammer members 20. The keyboard chassis 1, in which the hammer units 3 are mounted, includes the lower-limit stopper 13 and the upper-limit stopper 28 which are restriction members for restricting the rotation of each hammer member 20 within the restriction range.

Also, in this keyboard instrument, each hammer holder 21 includes the above-described first hammer restriction sections 32*a* that are a plurality of contact points on the effort point side which come in contact with portions of the plurality of hammer members 20 on the side of the key connecting sections 25 that are effort points when the hammer unit 30 is in a vertically inverted state, in order to achieve a structure where a first length L1 between each rotation shaft section 24 that is the fulcrum of one of the plurality of hammer members 20 and the leading end of the corresponding hammer member 20 on the weight section 23 side in the front-rear direction of the keys 2 is longer than a second length L2 between each rotation shaft section 24 and one end of the upper-limit stopper 28 on the rotation shaft section 24 side in the front-rear direction of the keys 2 when the hammer unit 30 is in the vertically inverted state so as to be mounted on the keyboard chassis 1. As a result, the rotation of each hammer member 20 can be restricted within the specific range, that is, the free rotation range F.

Moreover, in this keyboard instrument, when a hammer member 20 is rotated beyond the restriction range E which is the rotation range of the hammer member 20 when the corresponding key 2 is depressed, that is, the rotation range where the hammer member 20 is rotated between the lower-limit stopper 13 and the upper-limit stopper 28, the rotation of the hammer member 20 is restricted by the corresponding first hammer restriction section 32*a* which is a contact point on the effort point side. Accordingly, when a hammer holder 21 rotatably holding the hammer member 20 is to be mounted on the keyboard chassis 1, the hammer member 20 is prevented by the first hammer restriction section 32*a* from significantly hanging down, so that the assembling work efficiency is improved.

As described above, in this keyboard instrument, when a hammer member 20 is rotated beyond the restriction range E which is the rotation range of the hammer member 20 when the corresponding key 2 is depressed, that is, the range where the hammer member 20 is rotated between the lower-limit stopper 13 and the upper-limit stopper 28, the rotation of the hammer member 20 is restricted by the corresponding first hammer restriction section 32*a* which is a contact point on the effort point side. That is, when the hammer member 20 mounted on the keyboard chassis 1 by the corresponding hammer holder 21 is to be rotated in response to a key depression operation on the key 2 so as to apply action load, the rotating movement of the hammer member 20 is not blocked by the first hammer restriction section 32*a*.

Furthermore, in this keyboard instrument, the rotation of each hammer member 20 is restricted by the corresponding first hammer restriction section 32*a* which is a contact point on the effort point side, whereby the hanging down of the weight section 23 side of each hammer member 20 is suppressed to a minimum. Accordingly, when the hammer holders 21 rotatably holding the hammer members 20 are vertically inverted to be mounted on the keyboard chassis 1, the hammer members 20 are prevented from significantly hanging down, so that the assembling work efficiency is improved.

Still further, in this keyboard instrument, each hammer holder 21 holds the corresponding plurality of hammer members 20 such that, when the hammer unit 3 having this hammer holder 21 is vertically inverted and placed on a placement surface T so as to be mounted on the keyboard chassis 1, the supporting projections 27*c* of the hammer holder 21 which are upper end portions and the weight sections 23 of the plurality of hammer members 20 which are load points come in contact with the placement surface T. As a result, each hammer holder 21 can be stably placed on the placement surface T, so that the assembling work efficiency is improved.

That is, when portions of the hammer members 20 on the weight section 23 side and the hammer holder 21 are on the placement surface T, the hammer members 20 are not in contact with the first and second hammer restriction sections 32*a* and 32*b* of the hammer holder 21 which are restriction members. Therefore, after the hammer holder 21 rotatably holding the hammer members 20 is vertically inverted to be mounted on the keyboard chassis 1, this hammer holder 21 can be favorably held and lifted by the automatic assembly machine, which improves the assembling work efficiency.

Yet still further, in this keyboard instrument, in response to key depression operations, hammer members 20 are rotated within the restriction range E without coming in contact with their corresponding first hammer restriction sections 32*a* which are contact points on the effort point side. That is, when hammer members 20 are being rotated within the restriction range E so as to apply action loads to the corresponding keys 2 in response to key depression operations performed on the keys 2, the rotating movements of the hammer members 20 are not blocked by any first hammer restriction section 32*a*. As a result of this structure, the keys 2 can be favorably depressed.

Yet still further, in this keyboard instrument, the hammer holders 21 include the second hammer restriction sections 32*b* that are contact points on the load point side which come in contact with portions of the plurality of hammer members 20 on the weight section 23 side which is the load point side before the hammer units 3 are mounted on the keyboard chassis 1. Before the hammer units 3 are mounted on the keyboard chassis 1, each hammer member 20 is rotatable within the free rotation range F between the position where it comes in contact with the corresponding first hammer restriction sections 32*a* that is a contact point on the effort point side and the position where it comes in contact with the corresponding second hammer restriction section 32*b* that is a contact point on the load point side. Then, after the hammer units 3 are mounted on the keyboard chassis 1, each hammer member 20 is rotated within the restriction range E in response to a key depression operation, without coming in contact with the second hammer restriction section 32*b* that is a contact point on the load point side. As a result of this structure, when hammer members 20 are being rotated in response to key depression operations on the corresponding keys 2 so as to apply action loads to these keys 2, the rotation movements of the hammer members 20 are not blocked by any second hammer restriction section 32*b*. That is, key depression operations on the keys 2 can be favorably performed.

Yet still further, in this keyboard instrument, a plurality of hammer members 20 can be held by each hammer holder 21. Accordingly, by this hammer holder 21, the plurality of hammer members 20 can be mounted on the keyboard chassis 1 at once. By this structure as well, the assembling work efficiency can be improved.

Yet still further, in this keyboard instrument, each hammer holder 21 holds the corresponding hammer members 20 by its hammer holding sections 27 rotatably holding the hammer members 20 therebetween, whereby the hammer members 20 are unfailingly and favorably held.

That is, each hammer holding section 27 has the structure where the above-described shaft receiving holes 27*b* are provided in its pair of holding pieces 27*a* such that the centers of the shaft receiving holes 27*b* are positioned on the same axis, whereby the rotation shaft section 24 of each hammer member 20 can be favorably held between the corresponding pair of holding pieces 27*a* with it being inserted into the shaft receiving holes 27*b* therein. As a result of this structure, each hammer holding section 27 can rotatably hold the corresponding hammer member 20 unfailingly and favorably.

Yet still further, in this keyboard instrument, the predetermined hammer holding sections 27 have the supporting projections 27*c* which are identifiers for identifying whether a pair of holding pieces 27*a* is to hold a hammer member 20 for a white key or to hold a hammer member 20 for a black key. Accordingly, hammer members 20 for white keys and hammer members 20 for black keys can be distinctively attached for each hammer holding section 27 by the supporting projections 27*c* which are identifiers being used as markers.

That is, the identifiers in this keyboard instrument are a plurality of supporting projections provided on the upper ends of hammer holding sections 27 for holding hammer members 20 for white keys among the plurality of hammer holding sections 27, and are positioned higher than the upper ends of hammer holding sections 27 where hammer members 20 for black keys are attached. As a result, when the hammer members 20 for white keys and the hammer members 20 for black keys are to be attached, they can be distinctively attached by the supporting projections 27*c* of the hammer holding sections 27 being used as markers.

In addition, each hammer holder 21 holds the corresponding plurality of hammer members 20 such that, when the hammer unit 3 having this hammer holder 21 is vertically inverted and placed on a placement surface T so as to be mounted on the keyboard chassis 1, the plurality of supporting projections 27*c* of the hammer holder 21 and the weight sections 20 of the plurality of hammer members 20 which are load points come in contact with the placement surface T. Accordingly, each hammer member 20 does not come in contact with its corresponding first and second hammer restriction sections 32*a* and 32*b* which are restriction members on the hammer holder 21, and the hammer holder 21 can be stably arranged on the placement surface T. By this structure as well, the assembling work efficiency can be improved.

Also, in this keyboard instrument, the rotation shaft section 24 of each hammer member 20 includes the shaft body 24*a* which is inserted into the shaft receiving holes 27*b* of the corresponding pair of holding pieces 27*a*, and the flange section 24*b* having a brim shape and provided on the shaft body 24*a*. Accordingly, by the flange section 24*b* being pressed against the burr side surface of the corresponding hammer body 22, the burrs can be covered by the flange section 24*b*. As a result, even though the burrs are on the rim of the attachment hole 22*a* of the hammer body 22, the effect of these burrs can be prevented by being covered.

Moreover, each hammer member 20 is held by its rotation shaft section 24 being held between the pair of holding pieces 27*a* of the corresponding hammer holding section 27 with both ends of the shaft body 24*a* of the rotation shaft section 24 being inserted into the shaft receiving holes 27*b* of the pair of holding pieces 27*a*. Accordingly, by the above-described flange section 24*b* being arranged between the burr side surface of the hammer body 22 of the hammer member 20 and a surface of one of the holding pieces 27*a* opposing the burr side surface, the burr side surface of the hammer body 22 and the surface of one of the holding pieces 27*a* opposing it do not come in contact with each other, so that this holding piece 27*a* is prevented from being scraped by the burrs on the hammer body 22 when the hammer member 20 is rotated.

Furthermore, the upper parts of the opposing surfaces of each pair of holding pieces 27*a* are inclined such that the length therebetween becomes larger toward their upper ends. As a result, when the rotation shaft section 24 of each hammer body 22 is to be inserted between the corresponding pair of holding pieces 27*a*, the shaft body 24*a* of the rotation shaft section 24 can be easily inserted between the pair of holding pieces 27*a* by pressing them apart.

In addition, each of the plurality of contact ribs 30 on the opposing surfaces of each pair of holding pieces 27*a* is, excluding its inclined upper part, perpendicular to the upper surface of the base section 26 of the corresponding hammer holder 21 which is a horizontal surface, on which no draft is provided. As a result of this structure, the above-described flange section 24*b* arranged on the burr side surface of each hammer body 22 can be evenly pressed against the contact ribs 30 of one of the corresponding holding pieces 27*a*, and the side surface of this hammer body 22 opposite to the burr side can be evenly pressed against the contact ribs 30 of the other one of the holding pieces 27*a*.

Accordingly, by the contact ribs 30, the contact areas of each hammer member 20 with respect to the pair of holding pieces 27*a* of the corresponding hammer holding section 27 when this hammer member 20 is rotated are small. As a result, the frictional resistance between each pair of holding pieces 27*a* and the corresponding hammer member 20 is reduced, and the horizontal displacement of each hammer member 20 is prevented, whereby each hammer member 20 is smoothly rotated with it being favorably held.

In addition, in one of the opposing surfaces of each pair of holding pieces 27*a*, the above-described step recess section 31 is provided with it being enclosed by the corresponding contact ribs 30 positioned on both sides of the holding piece 27*a* in the front-rear direction. Accordingly, lubricant such as grease can be stored therein, and the outflow of the stored lubricant being prevented, so that the lubrication performance by the lubricant can be maintained for a long period of time.

Also, this keyboard instrument includes the first and second positioning sections 34 and 36 for positioning each hammer holder 21 with respect to the keyboard chassis 1. Accordingly, by these first and second positioning sections 34 and 36, the position of each hammer holder 21 in the array direction and the front-rear direction of the keys 2 can be precisely restricted, so that each hammer holder 21 can be precisely positioned to be mounted on the keyboard chassis 1.

That is, each first positioning section 34 is a clearance where one of the mounting bosses 33 of the keyboard chassis 1 is inserted. As a result of one of the mounting bosses 33 of the keyboard chassis 1 being inserted into this clearance, the first positioning section 34 positions its hammer holder 21 to be at the right position in the array direction of the keys 2. Also, each second positioning section 36 is an engaging projection which engages with the notch sections 35*a* provided on the predetermined reinforcing ribs 35 of the keyboard chassis 1. By this engaging projection being engaged with the notch sections 35*a* of the reinforcing ribs 35, its hammer holder 21 is set to be at the right position in the front-rear direction of the keys 2.

In the above-described embodiment, the rotation shaft sections 24 are provided in the hammer members 20, and the shaft receiving holes 27*b* are provided in the pair of holding pieces 27*a* of each hammer holding section 27 on each hammer holder 21 with the centers of the shaft receiving holes 27*b* being positioned on the same axis. However, the present invention is not limited thereto. For example, a structure may be adopted in which the shaft receiving holes 27*b* are provided in the hammer members 20, and the rotation shaft sections 24 are coaxially provided on the opposing surfaces of the pair of holding pieces 27*a* of each hammer holding section 27 on each hammer holder 21.

While the present invention has been described with reference to the preferred embodiments, it is intended that the invention be not limited by any of the details of the description therein but includes all the embodiments which fall within the scope of the appended claims.

What is claimed is:

1. A keyboard instrument comprising:

a hammer unit which includes (i) a plurality of hammer members each of which has an effort point provided on a first end side, a load point provided on a second end side, and a fulcrum provided between the effort point and the load point, and (ii) a hammer holder which rotatably holds the plurality of hammer members; and a keyboard chassis which includes a restriction member for restricting rotations of the plurality of hammer members performed in response to key depression operations within a restriction range, and in which the hammer unit is mounted, wherein the hammer holder has a plurality of contact points on an effort point side which contact with portions of the plurality of hammer members on the effort point side when the hammer unit is in a vertically inverted state, wherein, when the hammer unit is in the vertically inverted state, a first length between the fulcrum of each of the plurality of hammer members and the second end of each of the plurality of hammer members in a front-rear direction of keys is longer than a second length between the fulcrum and one end of the restriction member on a fulcrum side of the restriction member in the front-rear direction of the keys, and wherein the hammer unit is mountable on the keyboard chassis when in the vertically inverted state.

2. The keyboard instrument according to claim 1, wherein the hammer holder holds the plurality of hammer members such that an upper end of the hammer holder and the load point of each of the plurality of hammer members come in contact with a placement surface when the hammer unit is vertically inverted and placed on the placement surface before being mounted on the keyboard chassis.

3. The keyboard instrument according to claim 1, wherein the plurality of hammer members includes hammer members for white keys and hammer members for black keys which differ in shape from the hammer members for the white keys, wherein the hammer holder includes a plurality of holding sections for holding the plurality of hammer members, respectively, and wherein each of the plurality of holding sections has an identifier identifying whether the holding section is to hold a hammer member for a white key or to hold a hammer member for a black key before the hammer members are held by the plurality of holding sections.

4. The keyboard instrument according to claim 3, wherein the identifiers comprise a plurality of projections provided on upper ends of holding sections for holding the hammer members for the white keys from among the plurality of holding sections.

5. The keyboard instrument according to claim 4, wherein the hammer holder holds the plurality of hammer members such that the plurality of projections and the load point of each of the plurality of hammer members come in contact with a placement surface when the hammer unit is vertically inverted and placed on the placement surface before being mounted on the keyboard chassis.

6. The keyboard instrument according to claim 1, wherein the fulcrum of each of the plurality of hammer members includes a shaft, and the hammer holder includes a plurality of holes into which respective ones of the shafts are insertable.

7. The keyboard instrument according to claim 1, wherein the plurality of hammer members are rotated within the restriction range in response to the key depression operations, without coming in contact with the plurality of contact points on the effort point side.

8. The keyboard instrument according to claim 1, wherein the hammer holder has a plurality of contact points on a load point side which contact with portions of the plurality of hammer members on the load point side before the hammer unit is mounted on the keyboard chassis, and wherein the plurality of hammer members are (i) rotatable within a free rotation range between positions where the plurality of hammer members contact with the plurality of contact points on the load point side and positions where the plurality of hammer members contact with the plurality of contact points on the effort point side, before the hammer unit is mounted on the keyboard chassis, and (ii) rotated within the restriction range in response to the key depression operations without coming in contact with the plurality of contact points on the load point side, after the hammer unit is mounted on the keyboard chassis.

* * * * *